US006182865B1

(12) United States Patent
Bunschoten et al.

(10) Patent No.: US 6,182,865 B1
(45) Date of Patent: Feb. 6, 2001

(54) DEVICE FOR STORING A LIQUID CO-OPERABLE WITH A SPRAY DISPENSER, AND SPRAY DISPENSER COMPRISING SAID DEVICE

(75) Inventors: Gerrit Klaas Bunschoten; Norman Jason Pritchard, both of Maarssen (NL); Fredi Widmer, Munchwilen (CH)

(73) Assignee: Deversey Lever, Inc., Plymouth, MI (US)

( * ) Notice: Under 35 U.S.C. 154(b), the term of this patent shall be extended for 0 days.

(21) Appl. No.: 09/046,914

(22) Filed: Mar. 24, 1998

(30) Foreign Application Priority Data

Mar. 27, 1997 (EP) ..... 97200929

(51) Int. Cl.[7] ..... B67D 5/52
(52) U.S. Cl. ..... 222/136; 222/383.1
(58) Field of Search ..... 141/22, 9, 100, 141/381; 222/136, 382, 383.1

(56) References Cited

U.S. PATENT DOCUMENTS

| | | | | |
|---|---|---|---|---|
| 3,655,096 | | 4/1972 | Easter . | |
| 3,966,089 | | 6/1976 | Klingaman . | |
| 4,705,191 | * | 11/1987 | Itzel et al. | 222/383.1 |
| 4,832,230 | * | 5/1989 | Janowitz | 222/136 |
| 5,007,563 | | 4/1991 | De Laforcade . | |
| 5,421,483 | * | 6/1995 | Parise | 222/383.1 |
| 5,529,216 | | 6/1996 | Klima et al. . | |
| 5,836,479 | * | 11/1998 | Klima et al. | 222/383.1 |

FOREIGN PATENT DOCUMENTS

| | | |
|---|---|---|
| 35 35 986 | 4/1987 | (DE) . |
| 196 21 774 | 12/1997 | (DE) . |
| 606 672 | 7/1994 | (EP) . |
| 1188018 | 3/1985 | (IT) . |
| 81/01400 | 3/1981 | (WO) . |

OTHER PUBLICATIONS

Industrial Model Patent No. 207 355.
Industrial Invention Patent No. 11 880 18.

* cited by examiner

*Primary Examiner*—Philippe Derakshani
(74) *Attorney, Agent, or Firm*—Edward A. Squillante, Jr.

(57) ABSTRACT

The invention relates to a device for storing a liquid, particularly a dilutable concentrate such as a detergent concentrate or the like, the device being co-operable with a spray dispenser bottle and a spray dispenser head which which together from a spray dispenser, the device comprising:

a top wall and a bottom wall, the top wall and bottom wall being separated by one or more side walls, the top and bottom wall each having an opening continuous with a channel running through the device from the top wall opening to the bottom wall opening, whereby the top, bottom and sidewalls together with the channel, define at least one reservoir area of the device wherein liquid is storable, the device further comprising an exit in the device by relative displacement of parts thereof, whereby liquid is releasable from the reservoir area.

16 Claims, 4 Drawing Sheets

DEVICE FOR STORING A LIQUID CO-OPERABLE WITH A SPRAY DISPENSER, AND SPRAY DISPENSER COMPRISING SAID DEVICE

FIELD OF THE INVENTION

The present invention relates to a device for storing a liquid, particularly a dilutable concentrate such as a detergent concentrate or the like, which device is co-operable with a spray dispenser bottle and a spray dispenser head which together form a spray dispenser; to a spray dispenser comprising such a device and to a method for introducing a liquid concentrate, for example, into a spray dispenser bottle.

BACKGROUND OF THE INVENTION

The use of manually operable spray containers, especially spray bottles, for dispensing reagents such as water, detergent cleaners, de-icers, insecticides and the like, as an alternative to environmentally harmful aerosols, are well known.

The most spray dispenser bottles currently on the market, are pre-filled with a chemical reagent and sold ready to use.

Once the contents of these spray dispenser bottles have been used up, these spray dispenser bottles are often thrown away despite the fact that they mostly remain fully functional.

The U.S. Pat. No. 5,529,216 discloses a chemical reservoir mountable in the neck of a spray bottle dispenser for replenishing the active chemical reagent solution to be sprayed from the spray bottle dispenser. Accordingly, once the initial solution has been used up, the consumer need only refill the spray bottle with water, whereafter the chemical concentrate carried within the chemical reservoir is opened mixed with the water to provide a use solution.

U.S. Pat. No. 5,529,216 teaches a reservoir cartridge having a pierceable, metal foil upper wall and pierceable plastic lower wall. The concentrate contained herein, is released into a spray container bottle, by means of a needle member associated with a spray head, which is pushed through the upper metal foil wall and lower plastic wall of the reservoir cartridge to rupture these, on assembling the spray dispenser, whereby concentrate held therein is released into the spray bottle container through the ruptured lower wall of the cartridge. A disadvantage with this cartridge is that on piercing the lower wall, concentrate is not released at a sufficiently acceptable rate to provide quickly a use solution.

This needle member doubles as a down-tube for the spray head for transmitting liquid from the spray bottle to the spray head.

EP-A-0 606 672 discloses a system for diluting and dispensing liquid material including a rigid cartridge containing concentrated liquid, which cartridge is placed in the interior of the upper mouth of a bottle containing water. Said cartridge is opened at the bottom side thereof by screwing an atomizer onto a threaded mouth piece of the bottle, so that the concentrated liquid present in the rigid cartridge is released into the water. Further cartridge-like devices for use in recharging a chemical reagent solution in spray dispenser bottles, are known from the U.S. Pat. No. 3,655,096 and the German patent document DE 3535986.

A further system for introducing concentrate into a spray dispenser bottle is known from the German patent document DE 19621774.

Another system for introducing concentrate into a spray dispenser bottle is known from the Italian patent document no. 1188018.

Although the devices and systems known from the prior art are functional, they are difficult to make and/or awkward to fill with concentrate, and very often need to be thoroughly cleaned, once filled, in order to be ready for sale.

Furthermore, these types of cartridges often require relatively speaking, a lot of raw material, making them difficult to manufacture. Accordingly, these cartridges are often both with respect to man hours and raw materials expensive to make and fill, making them economically unattractive.

Another problem with known devices and systems is that standard spray containers and/or spray dispenser heads very often need to be modified and/or require extra working features, in order to co-operate therewith. Furthermore such known devices and systems often suffer from leakage.

Under standard spray containers is understood typically containers having a volume of 0.5–1.0 L with a single standard screw neck.

An object of the present invention is to provide a device which substantially overcomes all of these problems.

SUMMARY OF THE INVENTION

According to a first aspect, there is provided a device for storing a liquid, particularly a dilutable concentrate such as a detergent concentrate or the like, said device being co-operable with a spray dispenser bottle and a spray dispenser head which together form a spray dispenser, the device comprising:

a top wall and a bottom wall, said top wall and bottom wall being separated by one or more side walls, the top and bottom wall having an opening continuous with a channel running through the device from the top wall opening to the bottom wall opening, whereby the top, bottom and sidewalls together with the channel, define at least one reservoir area of the device wherein liquid is storable, said device further comprising exit creating means for creating an exit in said device by relative displacement of parts thereof, whereby liquid is releasable from the reservoir area.

According to another aspect of the present invention, there is provided a spray dispenser comprising a spray dispenser head, a device as described above, and a spray container, the device being mounted between the spray dispenser head and the spray container.

According to yet another aspect of the present invention, there is provided a method of introducing a liquid, particularly a concentrate, into a spray container in order to provide a use solution, comprising the steps of:

arranging a device according to any of the claims 1–13 in an opening of the spray container, arranging a spray head to fit on the container, whereby on removeably securing the spray head onto the container, the spray head presses down onto the device so that the channel and sidewalls thereof are mutually displaced whereby an exit is formed in the bottom wall of the device whereby liquid stored therein flows out of the device and into the container.

BRIEF DESCRIPTION OF THE DRAWINGS

The inventors have found that a considerable saving in raw materials is made utilizing a device according to the present invention.

Furthermore, the device according to the present invention is particularly easy to fill in an efficient way with liquid.

Since the device itself comprises the release means for releasing liquid from the reservoir area, this liquid release is easily and efficiently carried out and no additional co-operating features need be associated with either a spray head or spray container to open the device.

Moreover, standard spray bottles require little or no modification in order to co-operate with a device according to the present invention.

Figure 1:
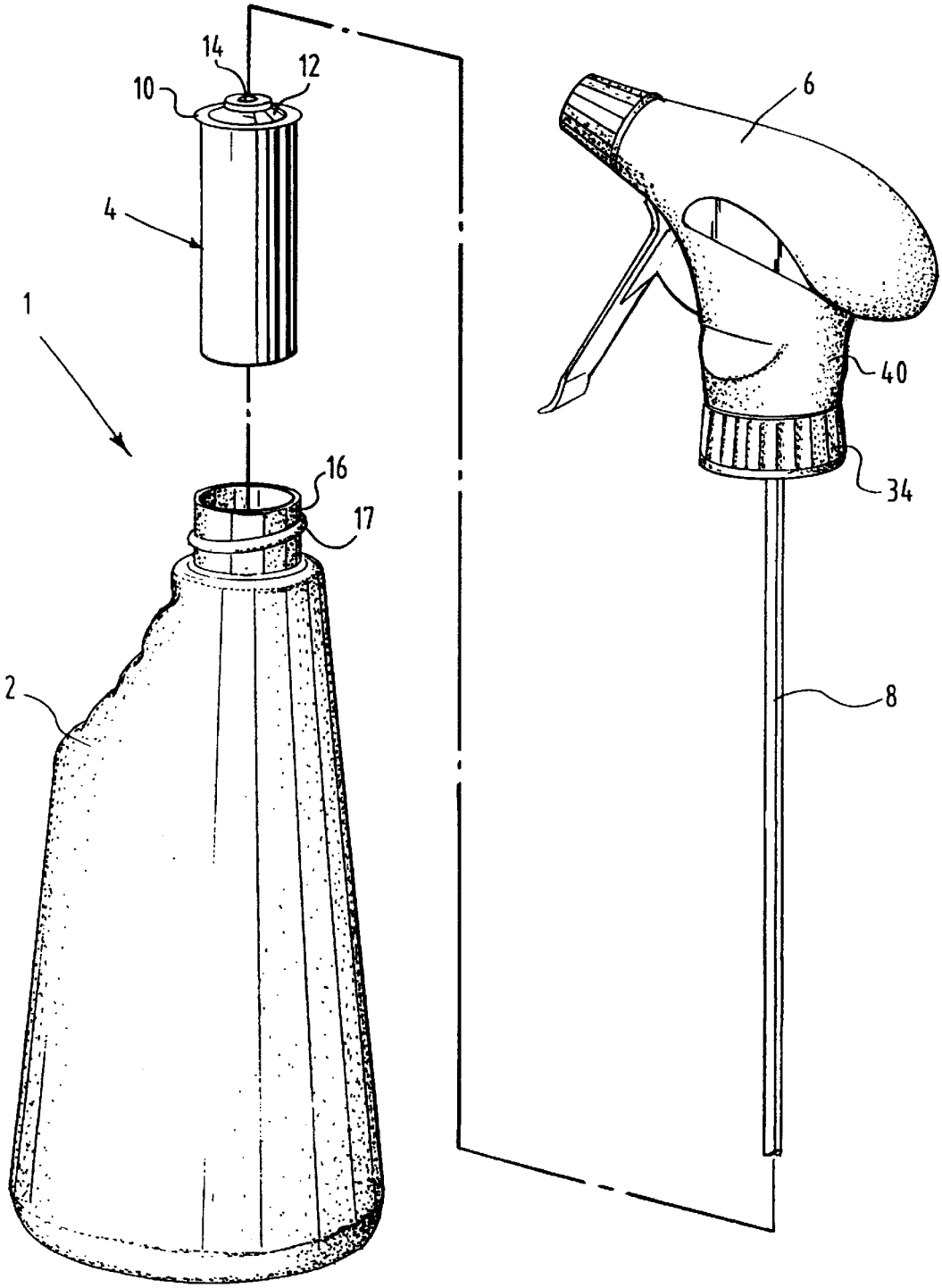
Figure 2:
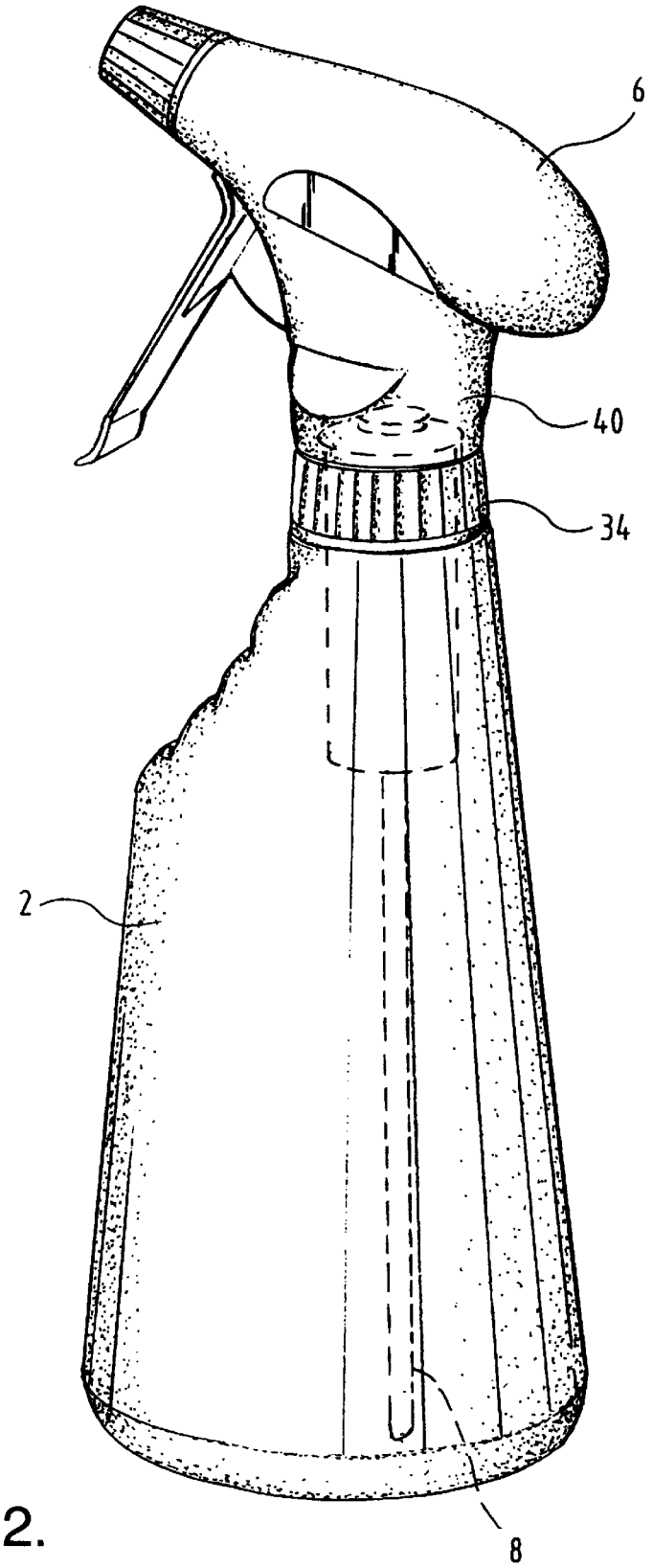
Figures 3A, 3B, 4A, 4B:
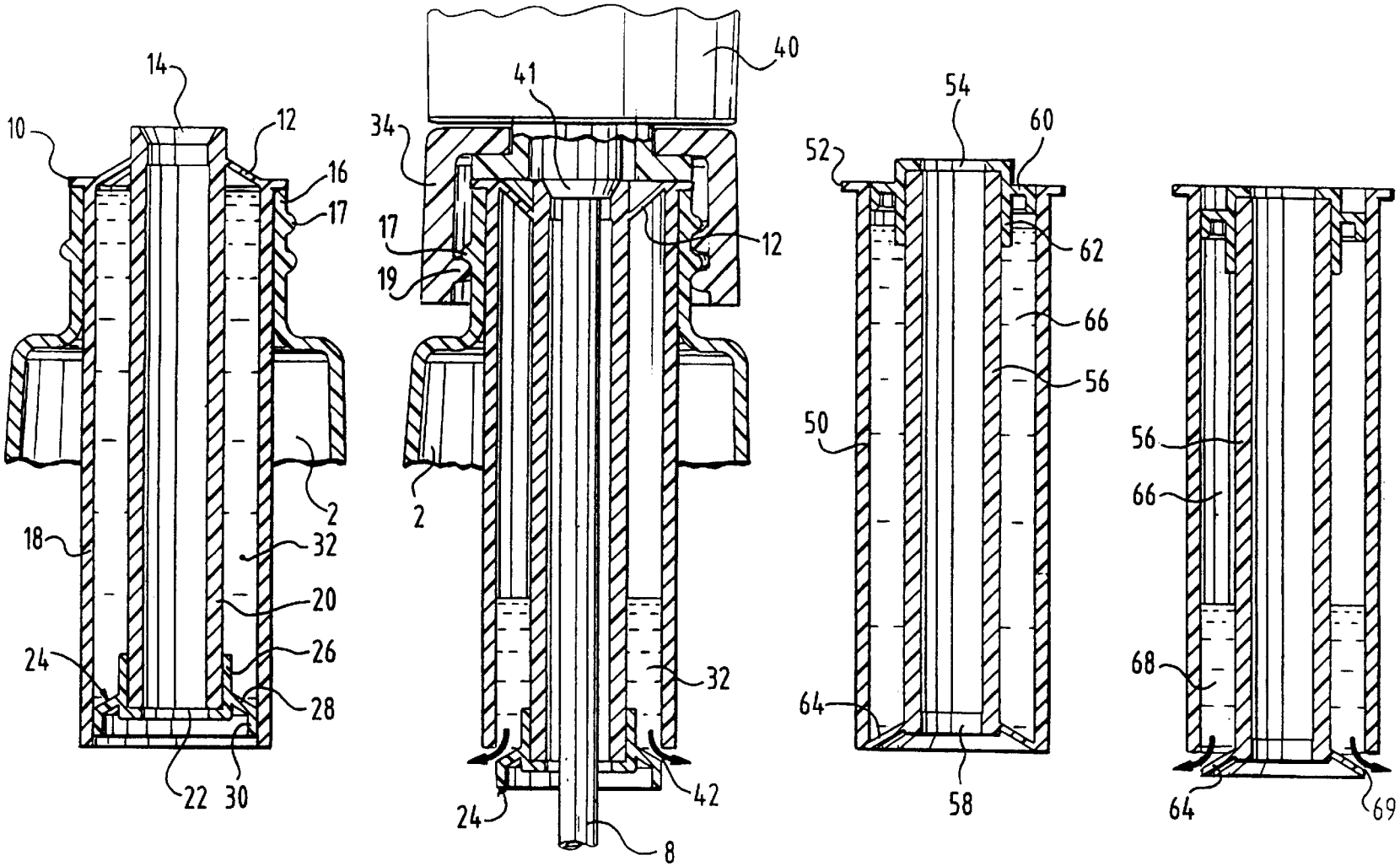
Figure 6:
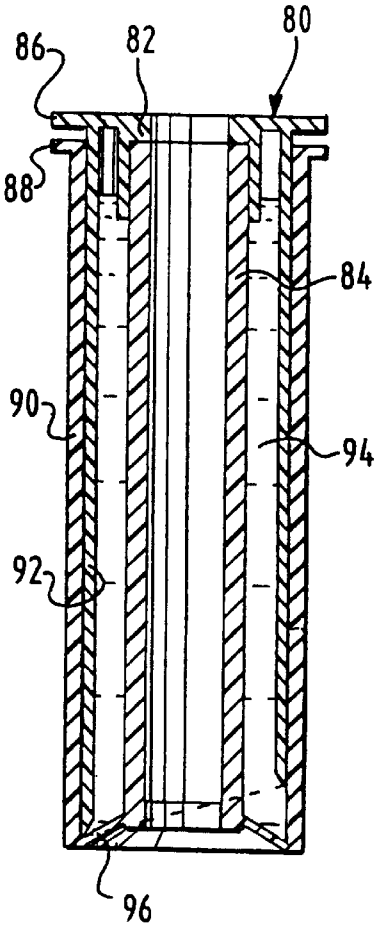
Figure 5B:
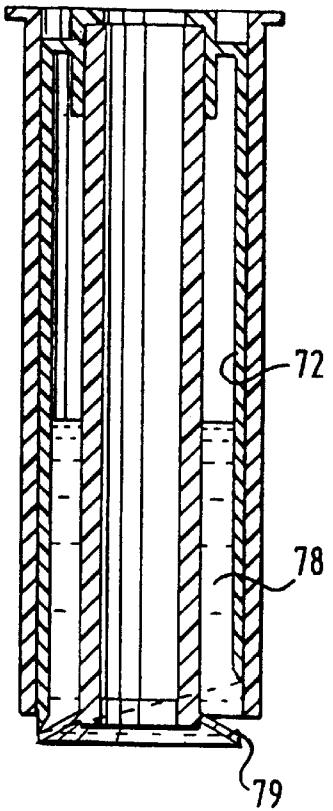
Figure 5A:
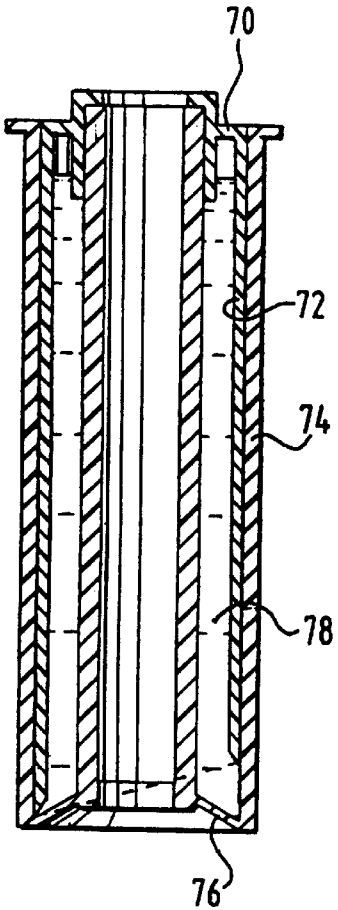

The invention will now be further clarified by way of the following specific description with reference to the accompanying drawings, wherein:

FIG. 1 shows a perspective, exploded view of a first preferred embodiment of an assembly according to the present invention;

FIG. 2 shows a perspective view of the assembly from FIG. 1;

FIG. 3*a* shows a cut away side view of a first preferred embodiment of a device according to the present invention, when sealed;

FIG. 3*b* shows a cut away side view of the device from FIG. 3*a* when open;

FIG. 4*a* shows a cut away side view of a second preferred embodiment of the device according to the present invention when sealed;

FIG. 4*b* shows a cut away side view of the device from FIG. 4*a* when open;

FIG. 5*a* shows a cut away side view of a third preferred embodiment of the device according to the present invention when sealed;

FIG. 5*b* shows a cut away side view of the device from FIG. 5*a* when open; and FIG. 6 shows a cut away side view of a fourth preferred embodiment of the device according to the present invention when sealed.

DETAILED DESCRIPTION OF THE PREFERRED EMBODIMENTS

An assembly 1 (FIG. 1) comprises a spray bottle dispenser 2, a device 4, in the form of a cartridge, and a spray head 6 having a down tube 8 connected thereto.

The cartridge 4 has a lip section 10 protruding outwardly from a top wall 12. The top wall 12 is provided with an opening 14.

In use, the cartridge 4 is inserted into a neck section 16 of the bottle 2 (see FIG. 2) so that the cartridge 4 is suspended by the lip section 10 (see FIG. 2).

The spray head 6 is subsequently screwed onto the neck section 16 of the bottle, the down tube 8 of the spray head 6 extending through a channel (see later) continuous with the top wall opening 14 of the cartridge 4 to terminate in the bottle 2 (see FIG. 2, FIGS. 3*a* and 3*b*).

The cartridge 4 (see FIGS. 3*a* and 3*b*), comprises a side wall 18, integral with the lip section 10 and flexible top wall 12.

Top wall opening 14 is continuous with a channel 20 extending through the cartridge 4, which channel 20 terminates in a bottom channel opening 22. As shown in FIGS. 1 and 2, this channel 20 can receive a down tube 8 associated with the spray head.

The side wall 18 and channel 20 define a reservoir area 32, sealed at one end of the device 4 by the flexible top wall 12 and at the other end of the device by a rigid bottom wall 24, extending from the bottom channel opening 22 to the side wall 18.

The bottom wall 24 comprises a first elongated part 26 arranged adjacent to the channel 20, a transverse piece 28 extending from said elongated part 26 to a downwardly extending sealing part 30 arranged adjacent to the side wall 18.

On arranging the assembly as shown in FIG. 1, the down tube 8 of the spray head 6 is inserted into opening 14 and pushed through the channel 20 (see FIGS. 3A and 3B).

On securing the spray head 6 to the neck section 16 of the bottle 2 by means of an interlocking screw thread 19 on the inside of a depending securing part 34 of the spray head 6, an upper neck section 41 of the down tube 8 presses down into the raised top wall opening 14 of the cartridge 4, whereby the channel 20, integrally connected with the flexible top wall 12, is in turn forced downward, the flexible top wall 12 being inverted downwards by this action, whereby the channel 20 pushes the rigid bottom wall 24 free of the side wall 18 (see FIG. 3*b*) in order to create an exit 42 wherethrough concentrate 32 is released to flow into the spray bottle 2 (FIG. 3*b*).

Once the spray bottle 2 has been emptied, instead of now disposing of the spray dispenser assembly, the now empty concentrate cartridge 4 can be simply removed, and following refilling of the spray bottle 2 with water, replaced with a new, fully charged concentrate cartridge 4.

A second preferred embodiment as shown in FIGS. 4*a* and 4*b* comprises a side wall 50 having a upper lip 52, an upper opening 54 continuous with a channel 56 which terminates in a lower opening 58. A top wall section 60 extends between the lip 52 and up and over the channel 56, to terminate at the edge channel opening 54. This upper wall section 60 is substantially rigid, having an extended support part 62 arranged adjacent to the channel 56.

At the lower end of the channel 56, a substantially rigid lower wall 64 extends downwardly from the channel 56 to the outer wall 50. The channel 56, the lower wall 64 and the side wall 50 are integral, i.e. they consist of one piece of preferably synthetic material. As with the previous embodiment, the outer wall 50 and the channel 56 define a concentrate reservoir area 66.

The lower wall 64 is more securely attached to the channel 56 than the outer wall 50.

The opening 54 extends in the sealed arrangement of the device (FIG. 4*a*) above the upper, outer lip 52.

On arranging a spray dispenser assembly, the upper neck section of a down tube presses down into the opening 54 whereby the channel 56 and upper wall 60 of the cartridge are pushed down with respect to the side wall 50, whereby in turn the seal between the lower wall 64 and the side wall 50 is broken, whereafter the concentrate within the cartridge is released, through opening 69, i.e. on displacement of the channel 56 with respect to the outer wall 50, since the lower wall 64 is more weakly integrally attached to the outer wall 50 than the channel 56, the lower wall 64 ruptures at its juncture with the outer wall 50, due to the rigidity of the lower wall 64, whereby an opening is created (FIG. 4*b*), wherethrough concentrate is released into the dispenser.

The further embodiment shown in FIGS. 5*a* and 5*b* is similar to the embodiment as shown in FIG. 4*a* and FIG. 4*b*, except that the top wall section 70 has a pushing section 72 integral therewith, which extends downwardly adjacent to the side wall 74 from the top of the cartridge to the bottom thereof, in order to contact, at one side, the lower wall 76 where this is sealed with the side wall 74. Accordingly on pushing down of the channel, this moves downwardly relative to the outer wall, whereby the top wall and accordingly the downwardly extending section 72 hereof also move downwardly with respect to the outer wall whereby the bottom wall is pushed open by the top wall pushing section 72. Concentrate 78 is thereby released through opening 79 (see FIG. 5*b*).

A fourth preferred embodiment of the cartridge according to the present invention is shown in FIG. 6. Here, the upper wall 80 is substantially T-shaped in cross section and comprises a first shoulder section 82 which rests on the top of the channel 84, said shoulder section 82 is continuous with a flat part 86 extending above a lip section 88 of the cartridge side wall 90 whereby an extended depending pushing section 92 depends from under the flat section 86 through the reservoir 94 adjacent the side wall 90 to contact the lower wall 96. On forcing down of the flat section 86, this comes to rest on the lip section 88, whereby the channel 84 and depending section 92 are forced downwards with respect to the side wall 90, thereby forming an exit between the lower wall 96 and the side wall 90 wherethrough the concentrate can be released.

As shown in FIGS. 5 and 6, the pushing section has the form of cylinder, one end of which has been obliquely cut off, one side of this pushing section is longer than the other, this side contacting the lower wall 76 in the 'closed' arrangement of the device (see FIGS. 5A, 6).

In the 'open' arrangement of the device (FIG. 5B), one side of the device consequently has a larger exit through which concentrate is releasable, since the pushing section at this side does not extend into the exit opening.

The invention is not limited to the above described preferred embodiments, the requested rights are determined by the following claims.

We claim:

1. A device for storing a liquid, said device being co-operable with a spray dispenser bottle and a spray dispenser head which together form a spray dispenser, the device comprising a top wall and a bottom wall, said top wall and bottom wall being separated by a sidewall, the bottom wall rupturable along a juncture with the sidewall, the top and bottom wall each having an opening continuous with a channel running through the device from the top wall opening to the bottom wall opening, whereby the top, bottom and sidewall together with the channel, define at least one reservoir area of the device wherein liquid is storable, said device further comprising an exit creating means for creating an exit in said device, whereby liquid is releasable from the reservoir area.

2. The device according to claim 1 wherein the device is substantially cylindrical in shape and having dimensions as to fit within a neck portion of a standard spray dispenser bottle.

3. The device according to claim 1 wherein the channel and the sidewall are dispaceable with respect to one another.

4. The device according to claim 1, wherein the exit creating means comprise the top wall, said top wall extending between the top wall opening and the sidewall, to be displaceable between a first position, wherein the liquid is storable in the reservoir area, and a second position wherein the liquid is releasable from said reservoir area.

5. The device according to claim 1, wherein the top wall is sealably attached with the top wall channel opening and the sidewall of the device.

6. The device according to claim 1, wherein the exit creating means further comprise the bottom wall, said bottom wall extending between the bottom wall channel opening and the sidewall of the device, to be displaceable between a closed position wherein the reservoir is sealed and an open position wherein the reservoir is sealed and an open position wherein an exit is present between the bottom wall and the reservoir area, in which position liquid in the reservoir is releasable from the device.

7. The device according to claim 1, wherein the top wall is integral with the top wall channel opening and the sidewall and is substantially flexible.

8. The device according to claim 1, wherein the bottom wall is integral with the bottom wall channel opening or the sidewall thereof.

9. The device according to claim 8, wherein the bottom wall is substantially rigid.

10. The device of claim 1, wherein the top all further comprises a pushing member, which extends from the top wall through the reservoir to contact the bottom wall.

11. The device of claim 1 wherein the channel protrudes from the top wall when the bottom wall occupies the closed position.

12. The device according to claim 1 further comprising a lip section which protrudes outwardly over the sidewall from the top wall.

13. An assembly comprising a spray dispenser head, a device according to claim 1 and a spray container.

14. A method of introducing a liquid into a spray container in order to provide a use solution, comprising the steps of:

arranging a device for storing a liquid, said device being co-operable with a spray dispenser bottle and a spray dispenser head which together form a spray dispenser, the device comprising a top wall and a bottom wall, said top wall and bottom wall being separated by a side wall, the bottom wall rupturable along a juncture with the sidewall, the top and bottom wall each having an opening continuous with a channel running through the device from the top wall opening to the bottom wall opening, whereby the top, bottom and sidewall together with the channel, define at least one reservoir area of the device wherein liquid is storable, said device further comprising an exit creating means for creating an exit in said device, whereby liquid is releasable from the reservoir area arranging a spray head to fit on the container, whereby the removeably securing the spray head onto the container, the spray head presses down onto the device so that the channel and sidewall thereof are mutually displaced whereby an exit is created in the bottom wall of the device whereby liquid stored therein flows out of the device and into the container.

15. The method of introducing a liquid into a spray container in order to provide a use solution, according to claim 14, wherein on mutual displacement of the channel and sidewall, a rupture forms along a juncture between the channel and sidewall, which rupture evolves into the exit wherethrough liquid flows into the container.

16. A spray bottle for spraying a liquid, the spray bottle comprising a device for storing a liquid and a dispenser bottle co-operable with a spray dispenser head, the device comprisin a top wall and a bottom wall, said top wall and bottom wal being separated by a side wall, the bottom wall rupturable along a juncture with the side wall, the top and bottom wall each having an opening continuous with a channel running through the device from the top wall opening to the bottom wall opening, whereby the top, bottom and side wall together with the channel, define at least one reservoir area of the device wherein the liquid is storable, said device further comprising an exit creating means for creating an exit in said device, whereby liquid is releasable from the reservoir area.

* * * * *